US007647921B2

(12) United States Patent
Mullin

(10) Patent No.: US 7,647,921 B2
(45) Date of Patent: Jan. 19, 2010

(54) SUBMERGING AIR PRESSURE PROJECTILE LAUNCHING SYSTEM

(76) Inventor: Keith Alan Mullin, 7423 Eads Ave., La Jolla, CA (US) 92037

( * ) Notice: Subject to any disclaimer, the term of this patent is extended or adjusted under 35 U.S.C. 154(b) by 0 days.

(21) Appl. No.: 11/950,380

(22) Filed: Dec. 4, 2007

(65) Prior Publication Data

US 2008/0127958 A1 Jun. 5, 2008

Related U.S. Application Data

(60) Provisional application No. 60/872,684, filed on Dec. 4, 2006.

(51) Int. Cl.
*F41B 11/00* (2006.01)

(52) U.S. Cl. ..... 124/56; 124/79; 124/63; 446/231; 446/159

(58) Field of Classification Search ..... 124/56, 124/63, 69, 79; 446/159, 231
See application file for complete search history.

(56) References Cited

U.S. PATENT DOCUMENTS 3,077,876 A * 2/1963 Richter ..... 124/65
3,962,818 A * 6/1976 Pippin, Jr. ..... 446/212
4,223,472 A * 9/1980 Fekete et al. ..... 446/192
5,377,656 A * 1/1995 Lewinski et al. ..... 124/65
5,415,153 A * 5/1995 Johnson et al. ..... 124/63
5,538,453 A * 7/1996 Johnson ..... 446/176
5,653,216 A * 8/1997 Johnson ..... 124/69
6,347,623 B1 * 2/2002 Kownacki et al. ..... 124/56
6,568,985 B1 * 5/2003 Binkley ..... 446/176
6,808,436 B1 * 10/2004 Siu ..... 446/231
6,926,579 B2 * 8/2005 Rappaport ..... 446/212
2005/0009440 A1 * 1/2005 Foster et al. ..... 446/231

* cited by examiner

*Primary Examiner*—Michael Carone
*Assistant Examiner*—Samir Abdosh

(57) ABSTRACT

A submerging air pressure projectile launching toy, suitable for use by children, includes a main device body, a launch structure connected to an upper end thereof to define an interior air chamber, and a projectile, all for use in water. The main device body has a hollow elongate member, defining a longitudinal axis, and a water intake, in fluid communication with the interior air chamber, at a lower end thereof, and the water intake opening is perpendicular to the longitudinal axis. The projectile is temporarily mountable via to the launch structure to semi-seal the interior air chamber. When the lower end of the main device body is pushed into a body of water, air within the interior air chamber is compressed until a frictional or other coupling force between the projectile and the launch structure is overcome, causing the projectile to launch into the air.

13 Claims, 10 Drawing Sheets

SUBMERGING AIR PRESSURE PROJECTILE LAUNCHING SYSTEM

CROSS-REFERENCE TO RELATED APPLICATION

The present application is a non-provisional patent application of, and claims the benefit under 35 U.S.C. § 119(e) to, U.S. Provisional Patent Application No. 60/872,684, filed Dec. 4, 2006, which is expressly incorporated by reference herein.

COPYRIGHT STATEMENT

All of the material in this patent document is subject to copyright protection under the copyright laws of the United States and of other countries. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE PRESENT INVENTION

1. Field of the Present Invention

The present invention relates generally to launching systems for toy rockets or the like, and, more specifically, it relates to a submerging air pressure projectile launching system for rockets or other projectiles to be launched and or fly when the launching system is plunged into a body of water.

2. Background

It can be appreciated that projectile launching systems such as toy rockets and the like have been in use for years. Typically, toy rocket launching systems have included solid fuel launching systems, hydrogen powered launching systems, pressurized water launching systems, pressurized air launching systems, and the like.

One main problem with conventional launching systems is that they require flammable fuel. Another problem with conventional launching systems is they are not designed to be operated in a water environment such as a pool. Another problem with conventional launching systems is that the required action, wherein the user pumps an air chamber or stomps on a bladder to pressurize air to launch an object, is problematic to perform in a pool.

Thus, while conventional devices may be suitable for the particular purpose to which they address, they are not as suitable for rockets or projectiles to be launched and or fly when the launching system is submerged in water.

In these respects, the submerging air pressure projectile launching system according to the present invention substantially departs from the conventional concepts and designs of the prior art, and in so doing provides an apparatus primarily developed for the purpose of rockets or projectiles to be launched and or fly when the launching system is submerged in water.

SUMMARY OF THE PRESENT INVENTION

In view of the foregoing disadvantages inherent in the known types of launching systems now present in the prior art, the present invention provides a new submerging air pressure projectile launching system construction wherein the same can be utilized for rockets or projectiles to be launched and or fly when the launching system is submerged in water.

The general purpose of the present invention, which will be described subsequently in greater detail, is to provide a new submerging air pressure projectile launching system that has many of the advantages of the launching systems mentioned heretofore and many novel features that result in a new submerging air pressure projectile launching system which is not anticipated, rendered obvious, suggested, or even implied by any of the prior art launching systems, either alone or in any combination thereof.

To attain this, in one or more embodiments, the present invention generally comprises a main body defining an air chamber, a launch structure, and one or more rockets or other projectiles. In at least one embodiment, the main body is comprised of a water intake, an air chamber and a connector or coupling. The air chamber holds air and allows air to be pressurized when one end of the chamber is semi sealed with the projectile and the other end makes contact with a water surface. The launch structure is a support for the projectile providing a semi permanent attachment interface using friction coupling between the launch structure and the projectile.

In at least one embodiment the launch structure has a male attachment member for the projectile, wherein the male end or stem is inserted into the projectile providing a semi permanent attachment or friction coupling between the stem and the interior of the projectile. The projectile is launched from the assembled main body and stem. The projectile has a female end which accepts the stem.

In at least one other embodiment, the launch structure does not utilize a stem; instead, the projectile is loaded at least partially in the interior of the hollow support body and held in place by a friction coupling between the exterior surfaces of the projectile and the interior surfaces of the hollow support body, thereby semi-sealing the air chamber inside the assembly. In at least one embodiment, the main body and launch structure are one member, where the outside of the top of the main body contains a friction fitting. In this embodiment, the projectile wraps around the friction fitting at the top of the main body creating friction coupling between the lower interior of the projectile and exterior surfaces of the main body, thereby semi-sealing the air chamber inside the assembly.

There has thus been outlined, rather broadly, the more important features of the invention in order that the detailed description thereof may be better understood, and in order that the present contribution to the art may be better appreciated. There are additional features of the invention that will be described hereinafter.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

One object of the present invention is to provide a submerging air pressure projectile launching system, for use as a toy or in other applications, that will overcome the shortcomings of the prior art devices.

An object of the present invention is to provide a submerging air pressure projectile launching system, for use as a toy or in other applications, for rockets or projectiles to be launched and or caused to fly when the loaded launching assembly is plunged into water.

Another object is to provide a submerging air pressure projectile launching system, for use as a toy or in other applications, that contains and pressurizes air in an air chamber when the lower end of the loaded launching system is plunged into a body of water with the pressurized air being the force for launching a rocket or projectile.

Another object is to provide a submerging air pressure projectile launching system, for use as a toy or in other applications, that can be used and operated in a pool or water environment or under water.

Another object is to provide a submerging air pressure projectile launching system, for use as a toy or in other applications, that has a launch structure providing a semi permanent attachment interface, using a friction coupling, between the launch structure and the main body.

Another object is to provide a submerging air pressure projectile launching system, for use as a toy or in other applications, that has a male end or stem which is inserted into a rocket or other projectile.

Another object is to provide a submerging air pressure projectile launching system, for use as a toy or in other applications, that uses the friction between the projectile and the launch structure to form a dynamic attachment or friction coupling of the launch structure and projectile.

Another object is to provide a submerging air pressure projectile launching system, for use as a toy or in other applications, that has a connector or attachment means between the main body and the launch structure. The connector or attachment means may be either permanent or semi permanent.

Another object is to provide a submerging air pressure projectile launching system, for use as a toy or in other applications, configured such that when the user plunges the submerging air pressure projectile launching system into water, the air in the air chamber is pressurized, and when the air pressure is greater than the frictional force present in the coupling between the projectile and the launch structure, the projectile is launched.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated.

BRIEF DESCRIPTION OF THE DRAWINGS

Further features, embodiments, and advantages of the present invention will become apparent from the following detailed description with reference to the drawings, wherein.

DETAILED DESCRIPTION OF THE PREFERRED EMBODIMENTS

Figure 1:
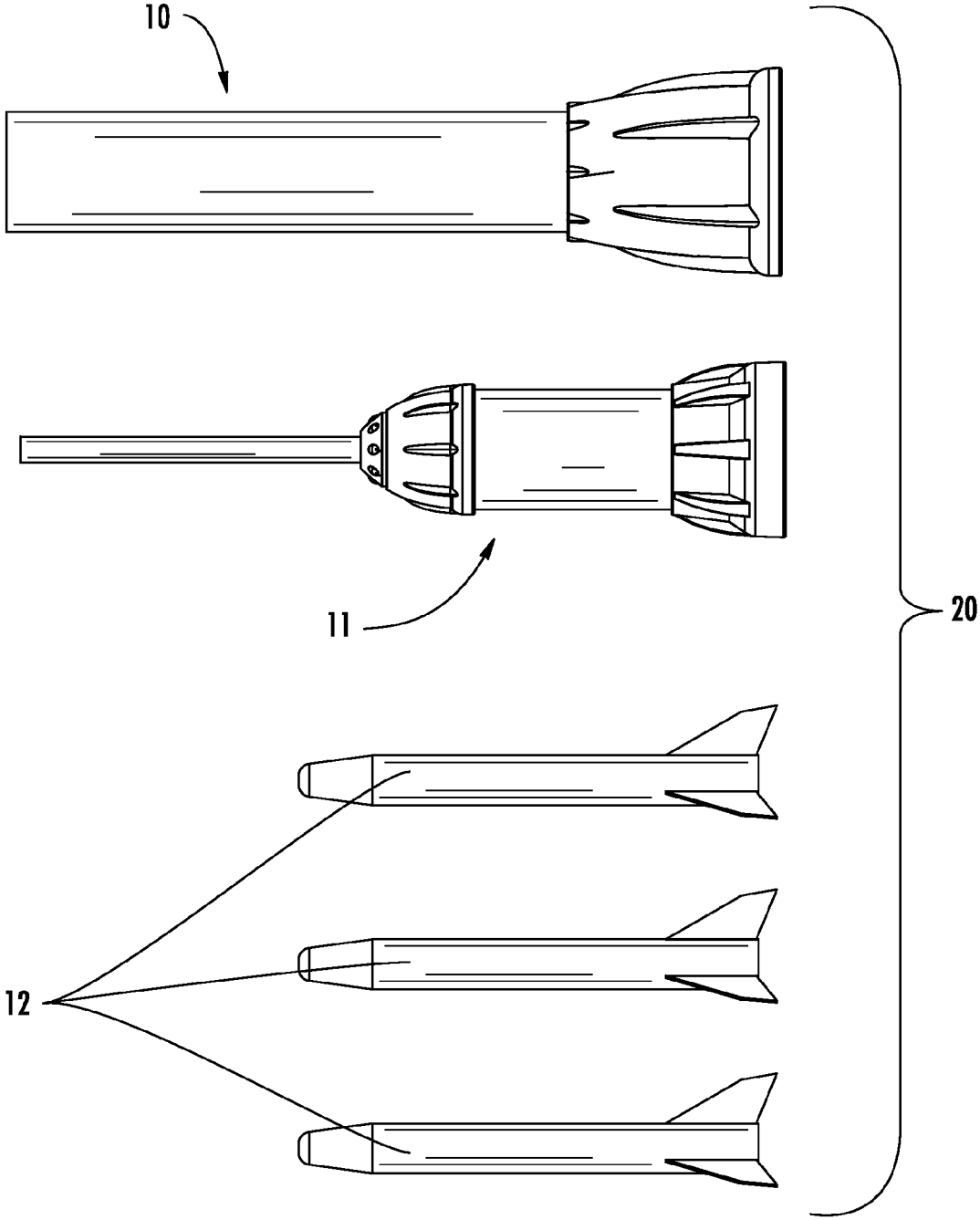
FIG. 1 is perspective view of a submerging air pressure projectile launching system in accordance with a preferred embodiment of the present invention.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, in which like numerals represent like components throughout the several views, the preferred embodiments of the present invention are next described. The following description of the preferred embodiment(s) is merely exemplary in nature and is in no way intended to limit the invention, its application, or uses.

FIG. 1 is perspective view of a submerging air pressure projectile launching system 20 in accordance with a first preferred embodiment of the present invention. In particular, FIG. 1 illustrates a toy rocket launching system 20 for use in a pool 14 or other body of water, but it will be apparent that the present invention will have many applications, some of which are described herein. The submerging air pressure projectile launching system 20 includes a main body 10, a launch structure 11 and one or more rockets 12 or other projectiles, each of which will be described in greater detail herein below. The main body 10 and launch structure 11 may sometimes be referred to collectively herein as a "device body," and the main body 10 may sometimes be referred to herein as a "main device body."

In at least one proposed commercial embodiment, the system 20 may be sold in the disassembled state shown in FIG. 1, at least some of the reasons for which being described herein below, and may include three or six rockets or other projectiles 12. However, it will be appreciated that other commercial embodiments may come with greater elements, such as a multi-part main body, or fewer elements to assemble or may come completely assembled, and may include greater or fewer numbers of rockets or other projectiles 12. Commercially, the rockets or other projectiles 12 may also be made available separately as replacement or supplemental parts for the system 20.

Figure 2:
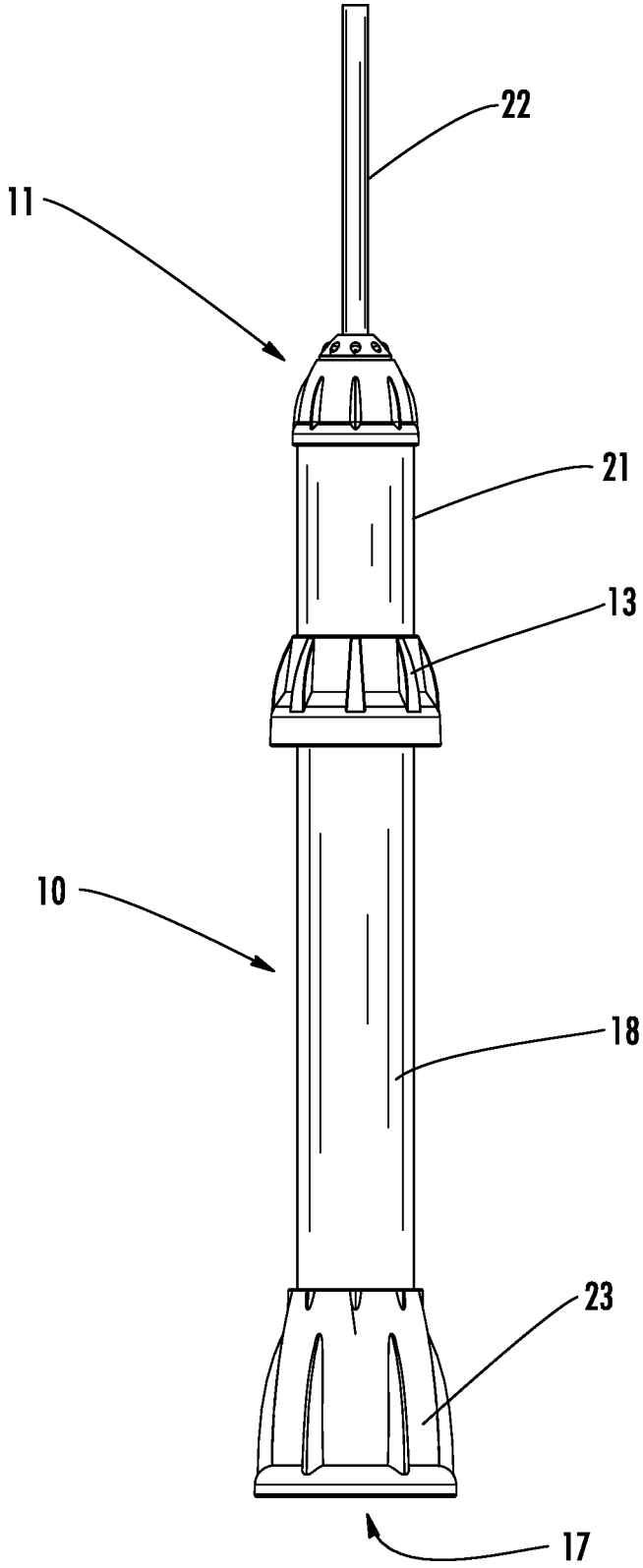
FIG. 2 is a perspective view of the main body and launch structure of FIG. 1, shown in an assembled state.
Figure 3:
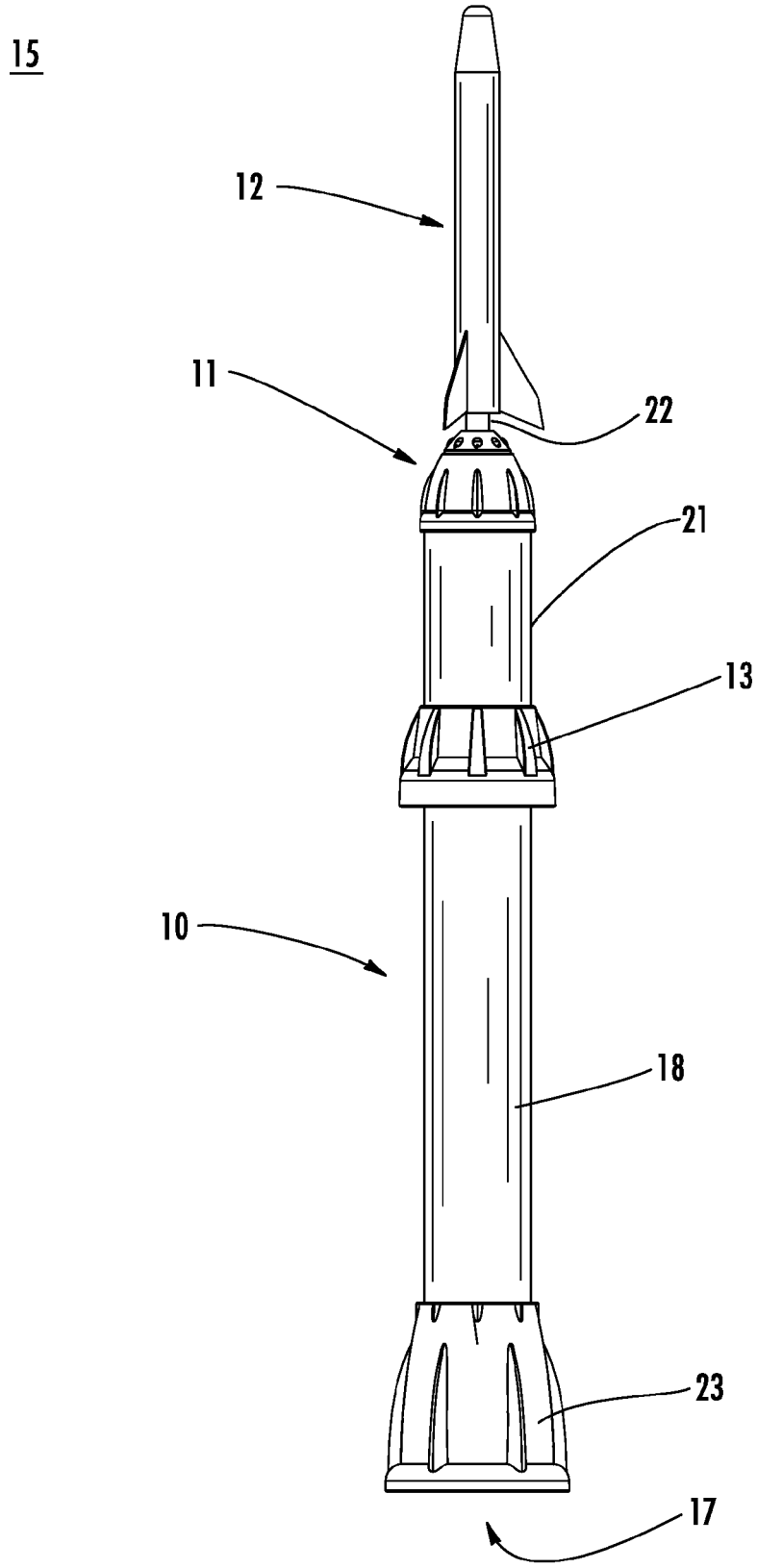
FIG. 3 is a perspective view of a loaded launching system, wherein one of the projectiles of the submerging air pressure launching system of FIG. 1 has been loaded onto the assembly of FIG. 2.
Figures 4A, 4B, 4C:
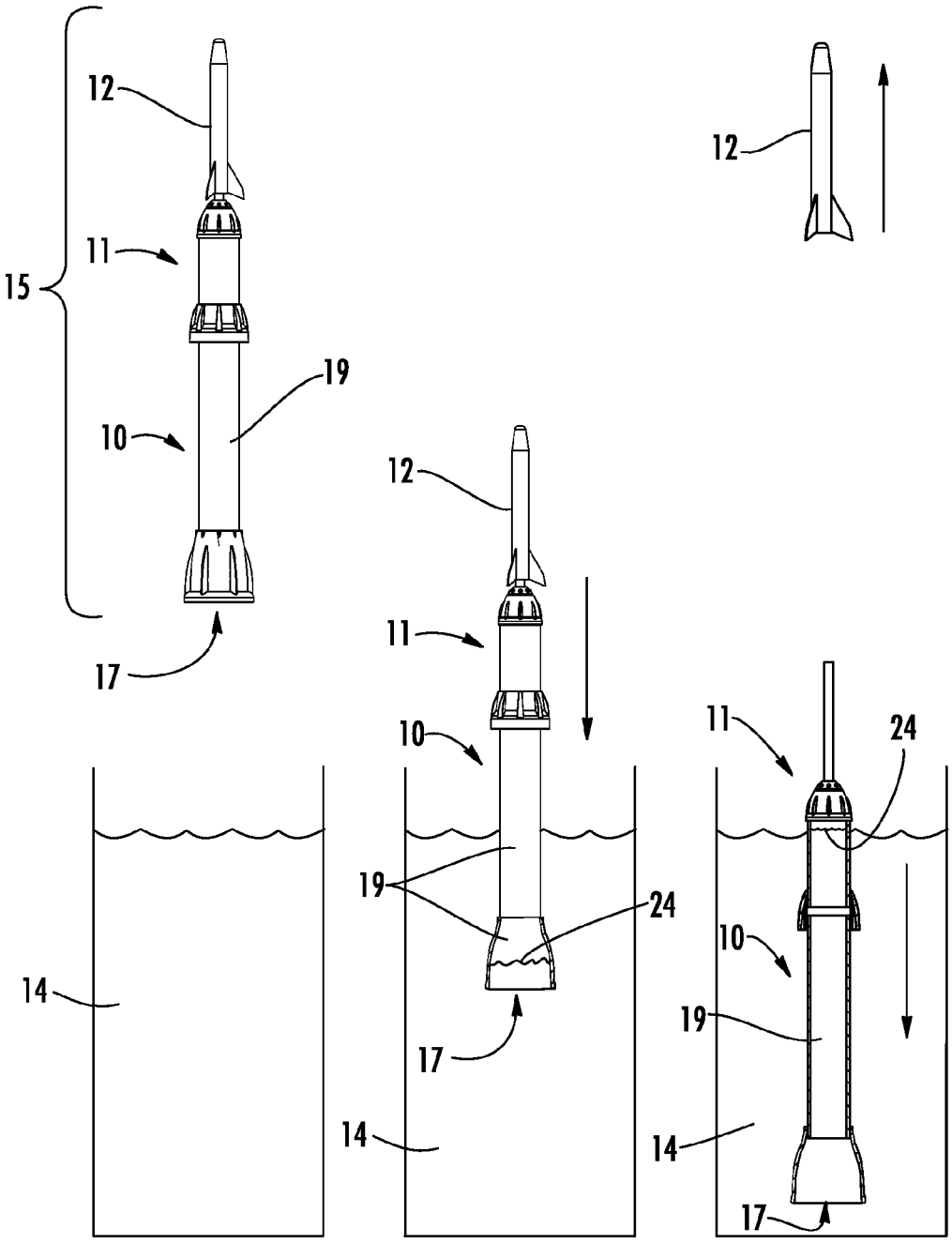
FIGS. 4A-4C are partially schematic views of the loaded launching system of FIG. 3, illustrating its operation.
Figure 10:
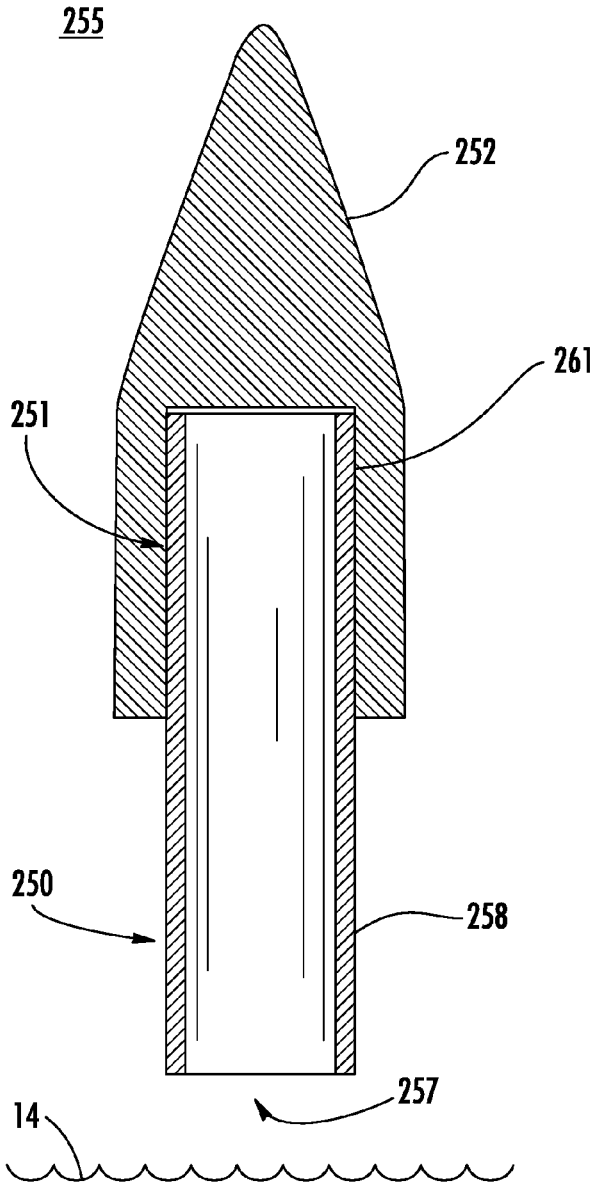
FIG. 10 is a cross sectional schematic view of a loaded launch system in accordance with a fifth preferred embodiment of the present invention.
Figure 11:
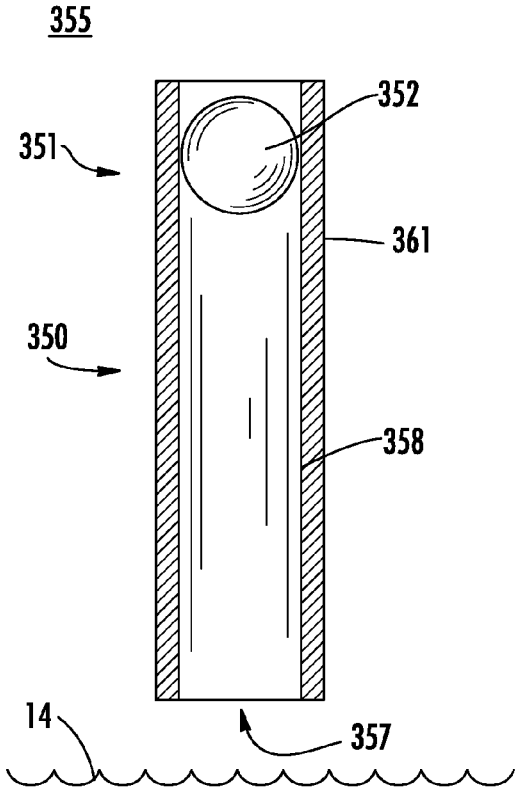
FIG. 11 is a cross sectional schematic view of a loaded launch system in accordance with a sixth preferred embodiment of the present invention.

FIG. 2 is a perspective view of the main body 10 and launch structure 11 of FIG. 1, shown in an assembled state. As illustrated therein, the main body 10 has an elongate hollow member 18 whose interior defines an air chamber 19 whose location is shown in FIGS. 4A-4C. In FIGS. 1-3 and the other embodiments illustrated herein, a lower end of the hollow member 18 defines a water intake 17, while an upper end of the hollow member 18 is adapted to couple to a connector 13 provided on a lower end of the launch structure 11 as further described below. It will be appreciated, however, that the water intake may alternatively, or in some cases additionally, be located elsewhere on the main body, such as intermediate the upper and lower ends of a hollow member (not illustrated) that defines a more circuitous route from the water intake to the launch structure than those variously defined in the illustrated embodiments. Further, a connector (not shown) may be provided at the upper end of the main body 10 to couple to the lower end of the launch structure 11, with or without a connector 13 thereon. Still further, in at least one embodiment, the main body 10 and launch structure 11 may be integral or continuous with each other, examples of which are shown in FIGS. 10 and 11. However, the two-piece construction, in which the two elements 10,11 are coupled together via one or more connectors 13, is thought to reduce shipping volumes and decrease retail shelf space required.

In yet another embodiment, at least one of the launch structure and main body are designed and dimensioned such that the launch structure is adapted to fit inside the main body and to telescope therefrom. In this arrangement, a modified connector (not shown) is provided that permits the launch structure to be fixed in place relative to the main body in an extended state, thereby providing an overall length similar to that shown in FIG. 2, but which also permits the launch structure to be retracted into the main body for shipping and/or storage. Such an arrangement is likewise thought to reduce shipping volumes and decrease retail shelf space required.

Also in at least one embodiment, the launch structure 11 can rotate, swivel, or extend at a fixed angle at or from the connector 13, thus enabling the rocket or projectile 12 to be launched at different angles.

An opening is defined through the connection 13 so as to provide a fluid passageway from the air chamber 19 to the interior of the launch structure 11. The water intake 17, which may be more specifically defined by a specialized structure 23, includes an opening whose width may or may not be greater than that of the opening in the connection 13. In at least one embodiment, the flared shape of the specialized structure 23, or alternatively of the lower end of the main body 10, is merely cosmetic.

Also in at least one embodiment, the launch structure 11 includes a hollow support body 21 with the connector 13 at its lower end and a relatively narrow tube or stem 22 at its upper end, with the interior of the support body 21 disposed in fluid communication with the interior of the stem 22. The exterior of the stem 22 forms a male attachment member or fitting and serves as a support structure for the rocket or projectile 12, as further described below. The support body 21 is semi-permanently or permanently coupled to the main body 10 via the connection 13 such that the fluid passageway described previously is established between the air chamber 19 of the main body 10 and the interior of the launch structure support body 21 and thus the interior of the stem 22. In the illustrated embodiment, the upper end of the hollow member 18 of the main body 10 and the lower end of the hollow support body 21 of the launch structure 11 are each arranged to fit snugly into a respective coaxial recess in the connector in a tight friction coupling, but it will be appreciated that any suitable connection means may likewise be utilized, including but not limited to a threaded screw coupling, a snap-fit coupling, or the like.

FIG. 3 is a perspective view of a loaded launching system 15, wherein one of the rockets or projectiles 12 of the submerging air pressure projectile launching system 20 of FIG. 1 has been loaded onto the assembly of FIG. 2. Each rocket or projectile 12 is configured such that it may be launched, and preferably flown or otherwise caused to travel through the air, from the loaded launching system 15 as described and illustrated herein. In this regard, each rocket or projectile 12 includes an open lower end and a closed upper end, with its lower end defining a female fitting which accepts the stem of the launch structure 11. Furthermore, the rocket or projectile 12 may be of any preferably aerodynamic design appropriate for air travel or flight. The rockets or projectiles 12 can be made of any shape or material appropriate for the application.

In particular, the rockets or projectiles 12 can be made of a lightweight foam material with fins added or integral therewith, all designed to suggest the appearance of a stylized rocket. Suitable materials may include, but are not limited to closed cell foam, Styrofoam, PVC, styrene, plastic, wood, paper, and the like.

The elongate hollow member 18 of the main body 10 and the hollow support body 21 of the launch structure 11 may be formed of any material and in any shape appropriate to hold, at least temporarily, pressurized air, but should be lightweight and suitable for use in water, including use in chlorinated water and seawater. Also, the stem 22 may be formed of any design or shape such that a friction coupling or other low-force coupling (such as may be afforded by a loose snap, clip, or the like) is provided between the stem 22 and the female end of the rocket or projectile 12.

The rocket or projectile 12 may be loaded onto the launch structure 11 by inserting the launch structure stem 22 into the open or female end of the rocket or projectile 12 and urging the rocket or projectile 12 downward until a semi-permanent attachment, via a friction coupling, is created between the launch structure stem 22 and the interior of the rocket or projectile 12. The design, materials and dimensions of the interior of the each rocket or projectile 12 and the exterior of the stem 22 are selected so as to create such an attachment and to thereby lightly seal the interior of the rocket or projectile 12 against the stem 22 and closing off the hollow interior of the launch structure 11. Further, the frictional force of the coupling should be selected so as to be great enough to hold the rocket or projectile 12 in place while the air pressure builds inside the air chamber 19 but low enough to be overcome once a preferred minimum pressure is reached in order to achieve the functionality described below. The selection of materials and parameters to achieve this balance will be apparent to the Ordinary Artisan. For example, the male and female inner and outer diameters can vary depending on the required coupling friction force, and different coupling forces may also be achieved by either of the two components being made of different rough or smooth surfaces.

FIGS. 4A-4C are partially schematic views of the loaded launching system 15 of FIG. 3, illustrating its operation. Preliminarily, a rocket or other projectile 12, is selected from the one or more rockets or projectiles 12 shown in FIG. 1 and is loaded onto the launch structure stem 22 of the assembly shown in FIG. 2, by inserting the stem 22 into the rocket or projectile 12, to create the loaded launching system 15 of FIG. 3. As shown in FIG. 4A, the loaded launching system 15 is then positioned over a body of water 14, such as a swimming pool or bathtub, and oriented generally vertically for proper operation. When held out of the water 14, the interiors of the main body 10, launch structure 11 and rocket or projectile 12, which are in fluid communication with one another, are open to ambient air pressure and the interior pressure is generally equalized throughout.

From the position shown in FIG. 4A, the loaded launch system 15 is then moved downward, as shown in FIG. 4B, pushing the lower end of the main body 10, including the water intake 17, into the water 14. Generally, the greater the rate of speed at which the loaded launch system 15 is pushed into the water 14, the higher flight elevation of the rocket or projectile 12, as further described herein below. Further, though not required, higher flight elevations may be achieved if the lower end of the loaded launch system 15 enters the water in a motion perpendicular to the surface of the water 14.

When the main body 10 is moved into the water 14, the water 14 acts to seal off the water intake 17 against the escape of air contained in the air chamber 19 therein, and as the main body 10 is pushed deeper, the water level 24 in the air chamber 19 inside the main body 10 rises, compressing the air within the air chamber 19 and thus within the launch structure 11 and rocket or projectile 12 as well, resisted by the friction coupling seal. The pressure in air chamber 19 rises as the water compresses the air upward into the launch structure 11 while resisted by the frictional coupling force generated by the rocket or projectile 12 on the launch structure stem 22. When the frictional coupling force is overcome by the force generated by the pressure of the compressed air in the air chamber 12, the rocket or projectile 12 is ejected from the launch structure 11, guided by the stem 22 in the direction the stem 22 is pointing. The distance of elevation traveled by the rocket or projectile 12 is dependent upon the amount of velocity and thus force used to push the loaded launch system 15 into the water 14, the pressure generated inside the air chamber 19, the amount of frictional coupling force existing between the rocket or projectile 12 and the stem 22, the weight of the rocket or projectile 12, the aerodynamics of the rocket or projectile 12, and the like. Thus, it is thought that the best results might be achieved using a relatively lightweight, aerodynamic projectile 12 and by plunging the water intake 17 into the water 14 as hard as possible and at an orientation that is as close to perpendicular to the surface of the water 14 as possible. During experimental use of a prototype thereof, a child was able to use the prototype in a pool 14 to repeatedly launch rockets or projectiles 12 a distance of 30 feet or more vertically into the air.

Figure 5:
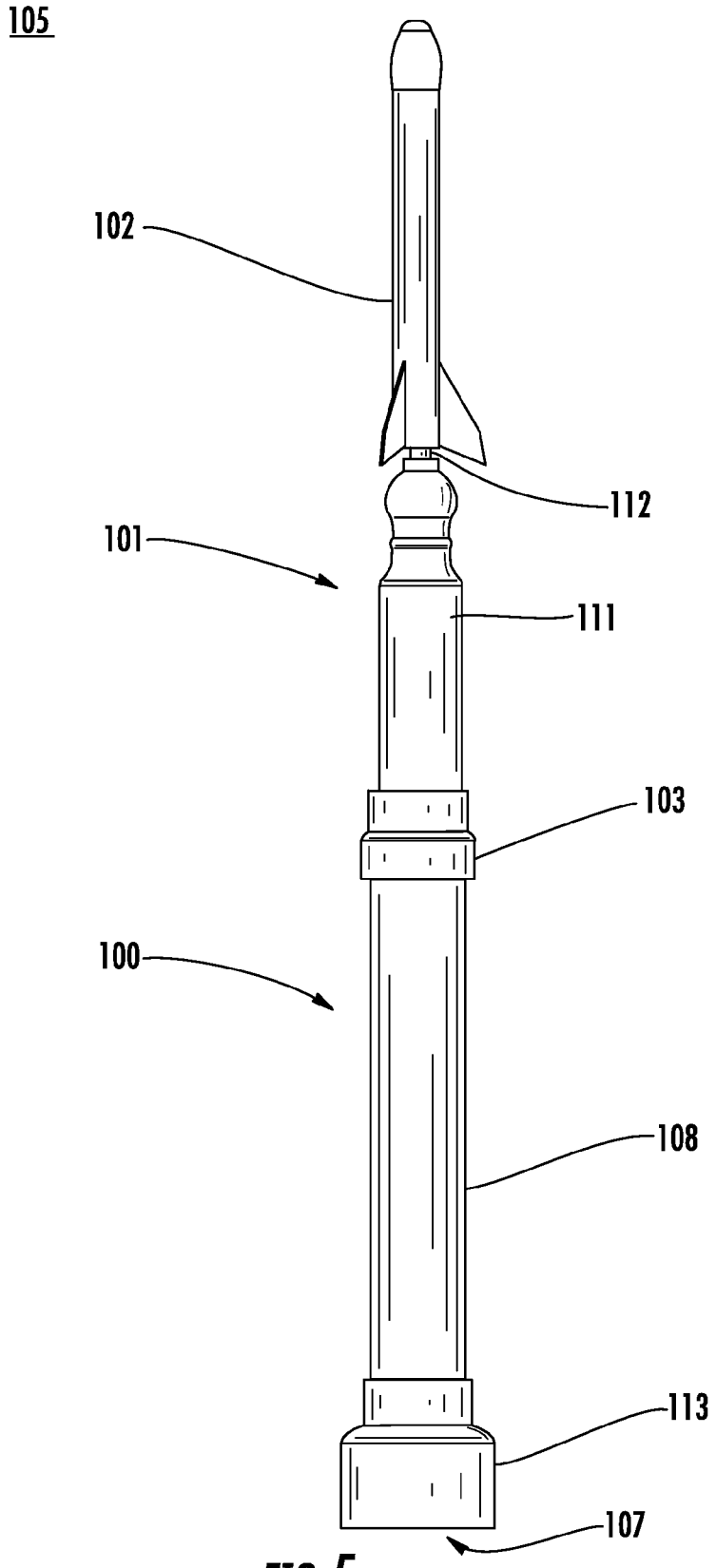
FIG. 5 is a perspective view of a loaded launching system in accordance with a second preferred embodiment of the present invention.

FIG. 5 is a perspective view of a loaded launching system 105 in accordance with a second preferred embodiment of the present invention. A submerging air pressure projectile launching system, of which the loaded launching system 105 of FIG. 5 is a part, includes a main body 100, a launch structure 101 and one or more rockets 102 or projectiles. As illustrated therein, the main body 100 is an elongate hollow member 108 whose interior defines an air chamber (not shown). A lower end of the hollow member 108 defines a water intake 107, while a connection 103 may be provided at an upper end of the hollow member 108 for frictional coupling with the launch structure 101. An opening is defined through the connection 103 so as to provide a fluid passageway from the air chamber to the interior of the launch structure 101. The water intake 107 may be more specifically defined by a specialized structure 113.

The launch structure 101 includes a hollow support body 111 at its lower end and a relatively narrow tube or stem 112 at its upper end, with the interior of the support body 111 disposed in fluid connection with the interior of the stem 112. The exterior of the stem 112 forms a male attachment member or fitting and serves as a support structure for the projectile 102, as further described below. The support body 111 is semi-permanently or permanently coupled to the main body 100 via the connection 103 such that the fluid passageway described previously is established between the air chamber of the main body 100 and the interior of the launch structure support body 111 and thus the interior of the stem 112.

Each projectile 102 is configured to be a projectile which may be launched from the loaded launch system 105 as described and illustrated herein. In this regard, each projectile 102 includes an open lower end and a closed upper end, with its lower end defining a female fitting which accepts the stem 112 of the launch structure 101. Furthermore, the projectile 102 may be of any preferably aerodynamic design appropriate for air travel or flight, and can be made of any shape or material appropriate for the application. In particular, the projectiles 12 can be made of a lightweight foam material with fins or wings added or integral therewith, all designed to suggest the appearance of a stylized rocket or plane.

The projectile 102 may be loaded onto the launch structure by inserting the launch structure stem 112 into the open or female end of the projectile 102 and urging the projectile 102 downward until a semi-permanent attachment, via a friction coupling, is created between the stem 112 and the interior of the projectile 102. The design, materials and dimensions of the interior of the each projectile 102 and the exterior of the stem 112 are selected so as to create such an attachment and to thereby lightly seal the interior of the projectile 102 against the stem 112 and closing off the hollow interior of the launch structure 101. Further, the frictional force of the coupling should be selected so as to be great enough to hold the rocket 102 in place while the air pressure builds inside the air chamber but low enough to be overcome once a predetermined pressure is reached in order to achieve the functionality described below. The selection of materials and parameters to achieve this balance will be apparent to the Ordinary Artisan. For example, the male and female inner and outer diameters can vary depending on the required coupling friction force, and different coupling forces may also be achieved by either of the two components being made of different ridged, smooth or rough surfaces.

Figure 6:
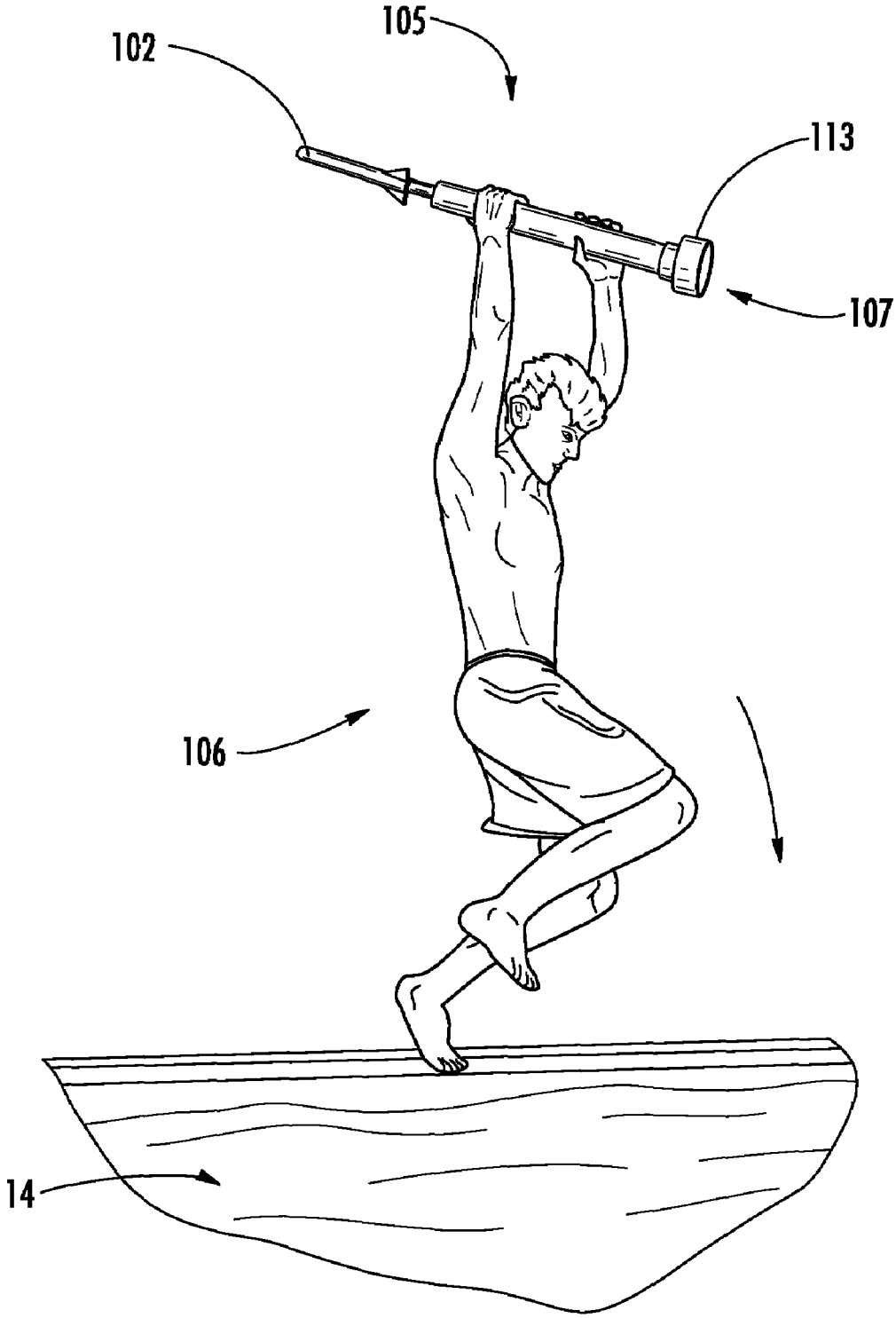
FIGS. 6 and 7 are illustrations depicting actual use of the loaded launching system of FIG. 5 prior to launch of the projectile loaded thereon.
Figure 7:
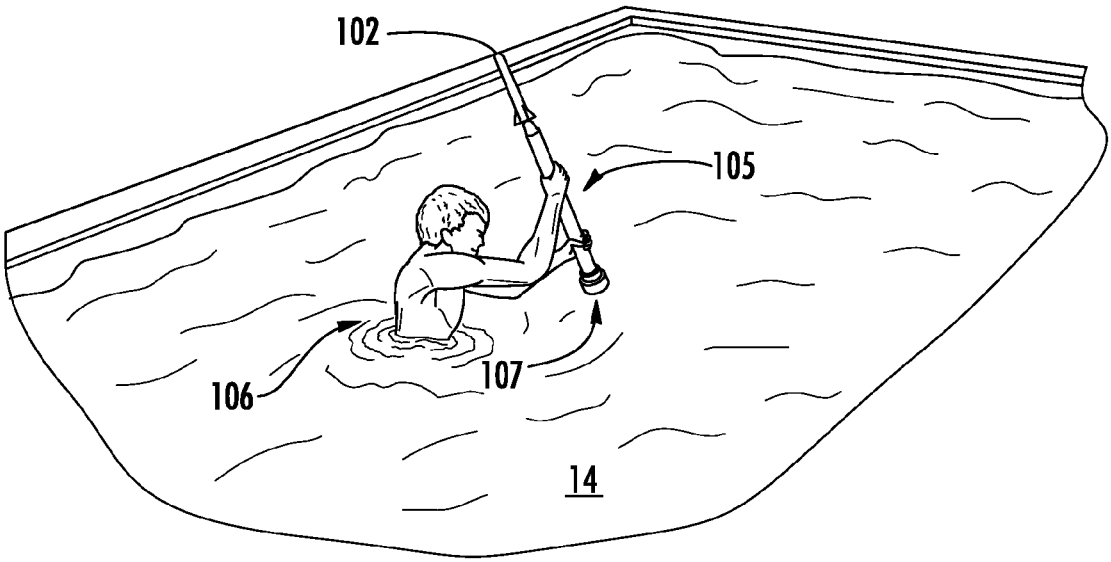

The operation of the loaded launch system 105 of FIG. 5 is similar to that shown in FIGS. 4A-4C. The operation is further illustrated in FIGS. 6 and 7, which depict actual use of a loaded launch system 105 of FIG. 5. As shown in FIG. 6, a user 106 may choose to jump into a pool or other body of water 14 while holding the loaded launch system 105 in any desired position, but preferably one in which the user 106 can thrust the lower end of the launch system 105 into the pool 14 with a significant velocity. In FIG. 6, the user 106 is holding the loaded launch system 105 over his head while he jumps into the pool 14. By the time he reaches the surface of the pool 14, similar to the position shown in FIG. 7, the user 106 preferably adjusts the loaded launch system 105 to a near-vertical orientation to maximize the amount of compressive force created within the air chamber 108. FIG. 7 also is illustrative of a user 106 who stands or sits in a pool, bathtub, or other body of water 14 and thrusts the launch system 105 into the surface of the water 14 beside him. Again, though not required, more effective results may be achieved if the lower end of the launch system 105 enters the water at an orientation perpendicular or close to perpendicular to the surface of the water 14.

Figure 8:
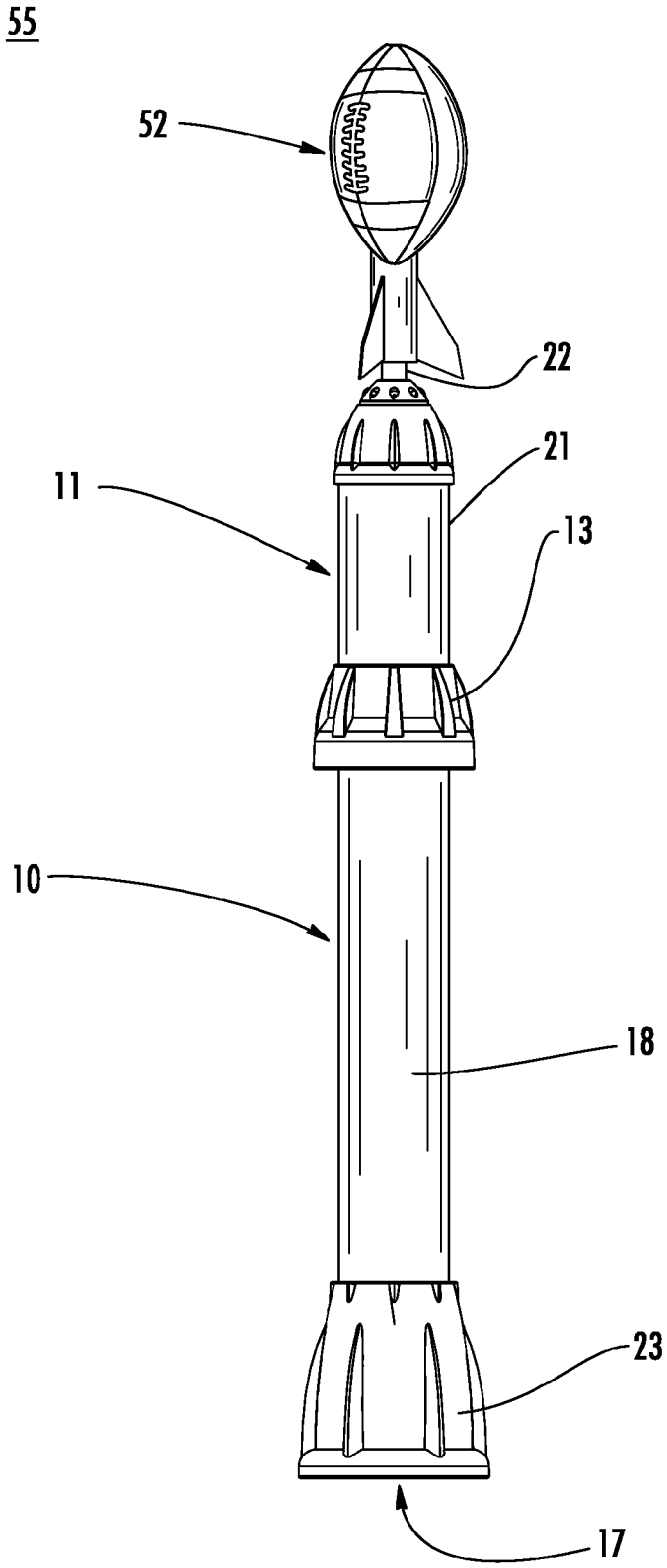
FIG. 8 is a perspective view of a loaded launching system in accordance with a third preferred embodiment of the present invention.

FIG. 8 is a perspective view of a loaded launch system 55 in accordance with a third preferred embodiment of the present invention. A submerging air pressure projectile launching system, of which the loaded launch system 55 of FIG. 8 is a part, includes a main body 10, a launch structure 11 and one or more projectiles in the shape of finned footballs or other balls 52. Other than the design of the respective projectiles 12,52 of FIGS. 3 and 8, the design, function and operation of the launch system 55 of FIG. 8 is generally similar in all respects to that of the launch system 15 of FIG. 3.

Figure 9:
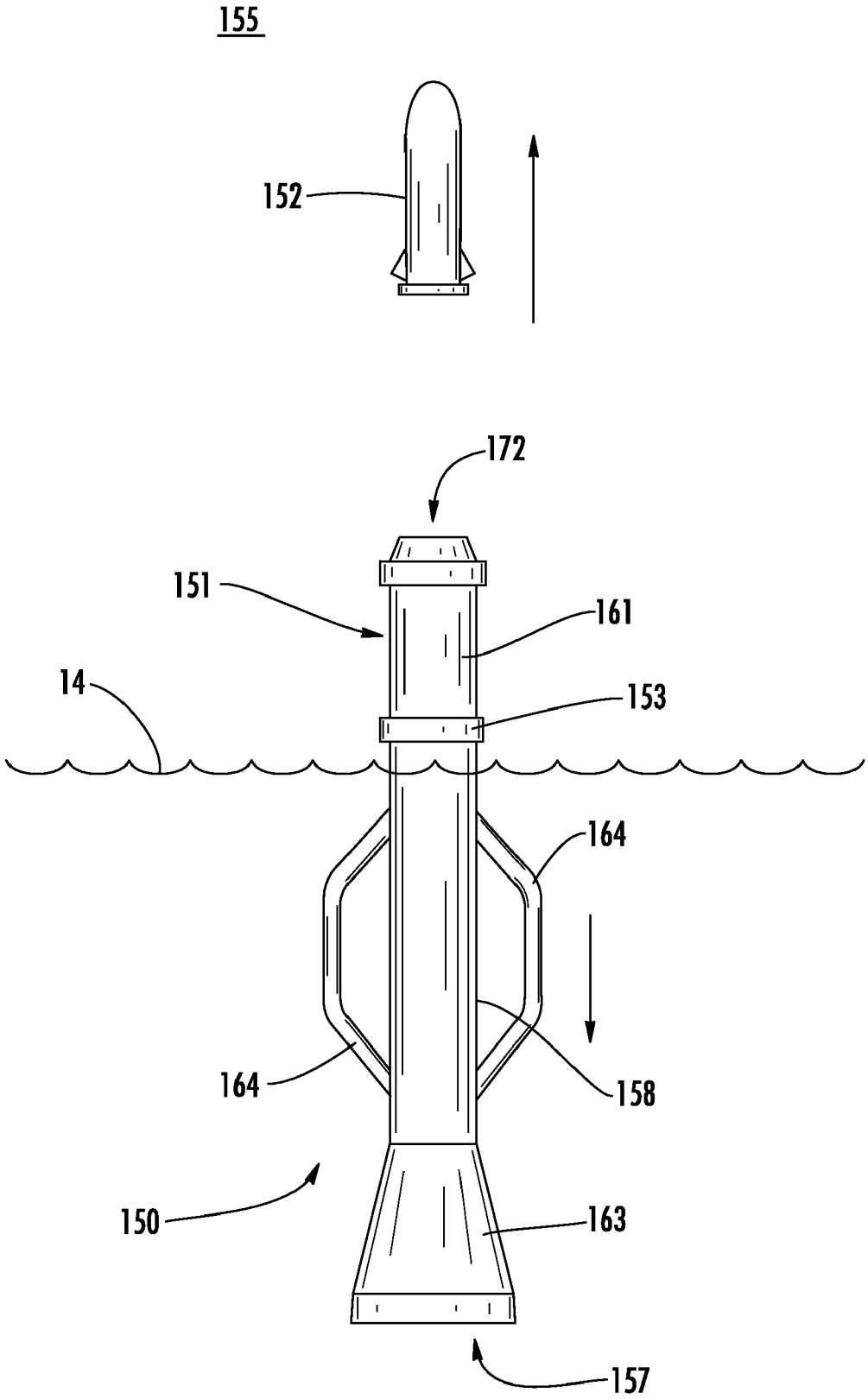
FIG. 9 is a perspective view of a launching system in accordance with a fourth preferred embodiment of the present invention.

FIG. 9 is a perspective view of a launch system 155 in accordance with a fourth preferred embodiment of the present invention. In general, this launch system 155 is somewhat similar in function and operation to the systems 15,105,55 of FIGS. 3, 5 and 8, respectively, in that it includes a main body 150, having an elongate hollow member 158 and a water intake 157 defined by a specialized structure 163, a launch structure 151, having a hollow support body 161, that is connected to the main body 150 by a connector 153, and a projectile 152, and in that it uses air compression, generated when the lower end of the launch system 155 is thrust into a body of water 14, to launch the projectile 152.

However, the launch system 155 of FIG. 9 includes a number of variations that, it will be appreciated, may be applied as alternatives or variations to any of the foregoing embodiments. First, the launch structure 151 does not utilize a stem; instead, the projectile 152 is loaded at least partially in the interior 172 of the hollow support body 161 and held in place by a friction coupling between the exterior surfaces of the projectile 152 and the interior surfaces of the hollow support body 161, thereby semi-sealing the air chamber inside the launch system 155. Similar to the operation of the other systems 15,105,55, the launch system of FIG. 9 utilizes the compression of the air in the air chamber to generate a force that, once it exceeds the frictional or other coupling force between the projectile 152 and the interior surfaces of the hollow support body 161, causes the projectile 152 to be ejected from the upper end of the launch structure 151.

The main body 150 of FIG. 9 is also provided with handles 164 on the exterior of the elongate hollow member 158. The handles 164 may make it more convenient for a user 106, such as the child shown in FIG. 6, to grasp and retain the launch system 155 during and after the launch of the projectile 152. Finally, the launch system 155 of FIG. 9 includes a number of additional minor features, none of which depart from the scope of the present invention.

FIG. 10 is a cross sectional schematic view of a loaded launch system 255 in accordance with a fifth preferred embodiment of the present invention. In general, this launch system 255 is somewhat similar in function and operation to the launch systems 15,105,55,155 of FIGS. 3, 5, 8 and 9, respectively, in that it includes a main body 250, having an elongate hollow member 258 and a water intake 257, a launch structure 251, a hollow support body 261, and a projectile 252 and in that it uses air compression, generated when the lower end of the launch system 255 is pushed into a body of water 14, to launch the projectile 252.

However, the launch system 255 includes a number of variations that, it will be appreciated, may be applied as alternatives or variations to any of the foregoing embodiments. First, the launch structure 251 in the system 255 of FIG. 10 does not utilize a stem; instead, the projectile 252 is loaded at least partially on the exterior of the hollow support body 261 and held in place by a friction coupling between the interior surfaces of the projectile 252 and the exterior surfaces of the hollow support body 261, thereby semi-sealing the air chamber inside the launch system 255. Second, the main body 250 and launch structure 251 are one continuous tube with no connector.

Similar to the operation of the other systems 15,105,55, 155, the launch system 255 of FIG. 10 utilizes the compression of the air in the air chamber to generate a force that, once it exceeds the frictional coupling force between the projectile 252 and the exterior surfaces of the hollow support body 261, causes the projectile 252 to eject from the upper end of the launch structure 251.

FIG. 11 is a cross sectional schematic view of a loaded launch system 355 in accordance with a sixth preferred embodiment of the present invention. In general, this launch system 355 is somewhat similar in function and operation to the systems 15,55,105,155,255 of FIGS. 3, 5, 8, 9 and 10, respectively, in that it includes a main body 350, having an elongate hollow member 358 and a water intake 357, a launch structure 351, a hollow support body 361, and a projectile 352 (which in this case is a spherical ball or other object) and in that it uses air compression, generated when the lower end of the launch system 355 is pushed into a body of water 14, to launch the projectile 352.

However, the launch system 355 includes a number of variations that, it will be appreciated, may be applied as alternatives or variations to any of the foregoing embodiments. First, like the launch structure 151 in the system 155 of the FIG. 9, the launch structure 351 does not utilize a stem; instead, the projectile 352 is loaded into the interior of the hollow support body 358 and held in place by a friction coupling between the exterior surfaces of the projectile 352 and the interior surfaces of the hollow support body 361, thereby semi-sealing the air chamber inside the launch system 355. Second, as with the launch system 255 of FIG. 10, the main body 350 and launch structure 351 are one continuous tube with no connector.

Similar to the operation of the other systems 15,105,55, 155,255, the launch system 355 of FIG. 11 utilizes the compression of the air in the air chamber to generate a force that, once it exceeds the frictional coupling force existing between the surfaces of the projectile 352 and the interior surfaces of the hollow support body 361, causes the projectile 352 to eject from of the upper end of the launch structure 351.

It will be appreciated that the teachings of the present invention are applicable to various devices and applications, including rocket toys of various dimensions for use in the pool, bathtub toys (which may preferably be smaller, for example, than the pool toy shown in FIGS. 6 and 7), signaling devices for attachment to a life vest or standalone use and intended for use at sea, and many other applications.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention and its methods of use.

Therefore, the foregoing is considered as illustrative only of the principles of the invention. Further, since numerous modifications and changes will readily occur to those skilled in the art. It is not desired to limit the invention to the exact construction and operation shown and described, and accordingly, all suitable modifications and equivalents may be resorted to, falling within the scope of the invention.

Based on the foregoing information, it is readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the present invention has been described herein in detail in relation to its preferred embodiment, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claims appended hereto and the equivalents thereof. Although specific terms are employed herein, they are used in a generic and descriptive sense only and not for the purpose of limitation.

What is claimed is:

1. A submerging air pressure projectile launching system, comprising:

(a) a device body, including a water intake and a launch structure, defining an interior air chamber, the water intake being disposed at, and having an exterior opening at, a lower end of the device body such that the interior air chamber is in fluid communication, via the water intake, with the environment that is exterior to the device body;

(b) a projectile, temporarily mountable to the launch structure to semi-seal the interior air chamber; and (c) a column of water temporarily disposed in the interior air chamber and in fluid connection with a body of water in the exterior environment;

(d) wherein, the submerging air pressure projectile launching system is configured such that, when the lower end of the device body is pushed into the body of water, water of the column of water temporarily enters the interior air chamber, and the temporary presence of the column of water in combination with submersion of the launch structure causes a compressive force to act upon air within the interior air chamber until a coupling force between the projectile and the launch structure is overcome, causing the projectile to launch into the air;

(e) whereby the submerging air pressure projectile launching system is configured such that pushing the lower end of the device body into the body of water effects launching of the projectile into the air.

2. The system of claim 1, wherein the coupling force is a frictional force.

3. The system of claim 2, wherein the launch structure is disposed at an upper end of the device body and includes a conduit, in fluid communication with the interior air chamber, that is closed and semi-sealed by the projectile when the projectile is mounted to the launch structure and open to ambient air when the projectile is launched into the air.

4. The system of claim 3, wherein the device body includes an elongate member defining a longitudinal axis, and wherein the water intake lies substantially in a plane that is substantially perpendicular to the longitudinal axis.

5. The system of claim 4, wherein the launch structure includes a stem, defining a male coupling, extending from a hollow support body, and wherein the projectile includes an open end, defining a female coupling, into which the stem may be inserted to temporarily mount the projectile thereon and to establish the friction coupling to semi-seal the interior air chamber.

6. The system of claim 4, wherein the launch structure includes a hollow support body, and wherein the projectile is adapted to temporarily mount within the hollow support body, thereby establishing the friction coupling to semi-seal the interior air chamber.

7. The system of claim 4, wherein the device body includes a main device body, wherein the main device body and the launch structure are connected together via a coupling.

8. The system of claim 4, wherein the device body includes a main device body that defines the longitudinal axis, and wherein the launch structure is angled relative to the longitudinal axis of the main device body.

9. The system of claim 4, wherein the device body and projectile are comprised of seawater- and chlorinated water-resistant materials.

10. A submerging air pressure projectile launching toy, suitable for use by children, comprising:

(a) a main device body, including a hollow elongate member and a water intake that is disposed at, and has an exterior opening at, a lower end thereof, the water intake being defined by an exteriorly-disposed structure having a generally circular opening whose cross-section is greater than that of the hollow elongate member;

(b) a launch structure, coupled to an upper end of the main device body, that includes a stem, defining a male coupling, extending from a hollow support body, wherein the main device body and the launch structure define an interior air chamber that is in fluid communication, via the water intake, with the environment that is exterior to the device body;

(c) a lightweight, aerodynamic projectile that includes an open end, defining a female coupling, that is temporarily mountable via friction coupling to the launch structure to semi-seal the interior air chamber; and (d) a column of water temporarily disposed in the interior air chamber in fluid connection with a body of water in the exterior environment;

(e) wherein, the submerging air pressure projectile launching system is configured such that, when the lower end of the device body is pushed into the body of water, water of the column of water temporarily enters the interior air chamber, and the presence of the column of water causes a compressive force to act upon air within the interior chamber until a frictional force between the projectile and the launch structure is overcome, causing the projectile to launch into the air;

(f) whereby the submerging air pressure projectile launching system is configured such that pushing the lower end of the device body into the body of water effects launching of the projectile into the air; and (g) wherein the main device body, the launch structure and the projectile are comprised of seawater and chlorinated water-resistant materials.

11. The system of claim 10, wherein the structure defining the water intake has a width greater than the interior air chamber.

12. The system of claim 10, wherein an interior of the exteriorly-disposed structure is inwardly tapered toward the interior air chamber.

13. The system of claim 10, wherein the path of water entering the exteriorly-disposed structure is narrowed as it is forced through the exteriorly-disposed structure and into the interior air chamber.

* * * * *